United States Patent [19]

Bryant, Jr. et al.

[11] 3,949,815

[45] Apr. 13, 1976

[54] SHALLOW-HOLE KERF BORING MACHINE WITH AUGER ON SIDE-ARM ELEVATING ASSEMBLY

[75] Inventors: William Sebert Bryant, Jr.; Cornelius Durham Garbutt, Jr., both of Summersville, W. Va.

[73] Assignee: Badger Manufacturing Corporation, Summersville, W. Va.

[22] Filed: July 24, 1974

[21] Appl. No.: 491,569

[52] U.S. Cl. ..... 173/23; 173/44; 173/46; 175/62; 175/219; 299/33; 299/55

[51] Int. Cl.[2] ..... E21C 25/58

[58] Field of Search ..... 173/22–28, 173/46; 175/62, 219; 299/55–57; 297/180

[56] References Cited

UNITED STATES PATENTS

| | | | |
|---|---|---|---|
| 425,718 | 4/1890 | Walker | 299/55 X |
| 444,476 | 1/1891 | Wolford | 173/24 X |
| 2,567,349 | 9/1951 | Reason | 297/180 |
| 3,395,940 | 8/1968 | Young et al. | 173/23 X |
| 3,834,761 | 9/1974 | Ray et al. | 173/23 |

*Primary Examiner*—Ernest R. Purser
*Attorney, Agent, or Firm*—Depaoli & O'Brien

[57] ABSTRACT

An augering machine and method for underground mining of minerals by selectively cutting shallow cylindrical kerfs into the face of a mine entry, comprising a wheeled vehicle having an independently elevatable side arm which carries a cutter head and an attached auger flight, a motor for rotation thereof, and a flight-advancing sump device. A selectively controllable operator-warming system that is usable for any hydraulically operated machine is also provided.

19 Claims, 15 Drawing Figures

SHALLOW-HOLE KERF BORING MACHINE WITH AUGER ON SIDE-ARM ELEVATING ASSEMBLY

BACKGROUND OF THE INVENTION

1. Field of the Invention

This invention relates to augering machines and further relates to void-creating devices for use in lateral blasting operations. It additionally relates to elevating devices for the boring assembly of an augering machine. It also relates to mining methods that utilize a blast-directing kerf.

2. Review of the Prior Art

Underground mining of coal and other minerals has long been done by cutting a horizontal slot or kerf in the face of a mineral vein to produce a mineral-accepting implosion void therein, boring a plurality of small shot holes into the mineral vein above the kerf and to the same depth as the kerf, inserting explosives into the shot holes, shooting or exploding the explosive to shatter the surrounding mineral and deposit it in the kerf, and removing the broken mineral before repeating the operation. The kerf thus functions as a lateral reaction-directing means so that the force of the explosion is expanded more nearly vertically than outwardly.

Chain-bar cutting machines have been in existence since about 1895 for creating such kerfs in coal seams. Early machines were mounted on rails and could cut to a depth of about four feet under the coal seam. In the early days, bug dust (the flour-size fine coal cuttings) was removed from the kerf so that shooting down the coal was quite effective, particularly when compared to kerfs which were hand-cut with picks and when compared to shooting-on-the-solid (no undercut). Under current practice, this bug dust is not removed.

The basic concept has evolved into the large cutting machines of today which are capable of cutting kerfs having a depth of 10–12 feet. The only major improvement thereover is the universal cutting machine having a cutting boom which can be rotated and raised to approximately 92 inches.

Kerf-cutting machines currently in use are heavy and long (up to 31 feet with boom). A typical machine using alternating current has a 185-horsepower bit motor and a 65-horsepower pump motor. The cutter bar with exposed bits is dangerous and unwieldy. Engineering studies by major mining companies show that 54% of the bug dust remains in a kerf which has been cut by a conventional machine. This unremoved bug dust creates two problems. Firstly, the bug dust creates a cushion which reduces the effectiveness of the shooting and, secondly, the bug dust blows out into the entry and is both an explosion hazard and a respiratory problem. Bug dust is also neither transportable nor saleable.

A slot-like kerf is apparently advantageous from geometry considerations, but the proportion of mineral-receiving void to shattered mineral is low. For example, such a kerf, having a thickness of 4 inches, a width of 20 feet, and a depth of 10 feet, creates a void volume of 67 cubic feet. If a mineral seam is 4½ feet thick, there are 833 cubic feet of mineral remaining alongside the kerf to be shattered and downwardly expanded toward and into this kerf which provides a mere 8% for such expansion.

On the other hand, if a single cylindrical hole, having a diameter of 2 feet, is bored into the mineral face, there is a void of about 31 cubic feet created in the 900 cubic feet of original mineral. Four such holes, or a single 4 foot diameter hole, have a total void of about 126 cubic feet, furnishing an expansion void equaling about 16% of the remaining mineral or nearly as much as a double cut of 8 inches in thickness.

By cutting one or more cylindrical kerfs with an augering machine, lump coal is automatically extracted therefrom and little dust is created, so that the unsaleability, respiratory and explosive hazards, and cushioning effects of bug dust are eliminated. In addition, the lateral reactive forces created by the explosion are primarily directed sidewardly rather than vertically so that roof damage is minimized. Because roof falls are still the foremost cause of death in coal mining, and indeed were responsible for nearly half the 1973 coal mine deaths, this benefit is alone of considerable importance.

Auger mining machines for mining coal and other minerals from relatively thin veins thereof have been in use for years and have been particularly recommended for mines having poor roof conditions. Such machines comprise a rotary cutting head and a plurality of flights of a spiral conveyor which are sequentially attached in series for boring holes of considerable depth, such as 80 feet to 150 feet. Each flight is generally of a uniform length, such as 6, 10, or 12 feet.

Deep-mine augering machines require an auger elevating means in order to emplace the cutter head at any selected location that is above the floor of the mine entry. An early auger elevating means of the prior art is a rack-and pinion device at each corner of an auger mining machine, as described in U.S. Pat. No. 2,394,194, for elevating the entire machine. Hydraulic jacks, mounted at each corner for separate elevation of the front and rear of the machine in order to compensate for changes in pitch of the seam, were later developed, as described in U.S. Pat. No. 2,880,707.

A deep-mine augering machine, having a rigid anchor frame, a laterally reciprocative sump frame, and a longitudinally reciprocative carriage, is described in copending application Ser. No. 295,511, now U.S. Pat. No. 3,834,761, issued Sept. 10, 1974. In order to bore holes at any elevation in a mineral seam, the entire machine is raised by elevating the underlying anchor frame on the four corner jacks attached thereto. The machine is suggested for use in carrying out a deep-hole method of boring a deep cylindrical kerf to be used for repeated core drilling, shooting, and removing of the shattered coal. An adjacent hole is required for storing auger flights before sequential use thereof.

An arcuately movable and independently operable elevating means is disclosed in U.S. Pat. No. 2,846,093 for a separate transfer mechanism which sequentially removes the auger flights stored in a previously bored hole and transfers them to a nearby auger boring machine which is positioned in front of another hole being bored. This elevating means comprises a rigidly connected pair of side members which are pivotably connected at their lower ends to rollers riding on a pair of rails and have curved seats at their upper ends for supporting an extracted auger flight at a desired elevation.

However, a method of utilizing cylindrical kerfs as expansion voids without requiring an adjacent hole for storage of a large number of bulky, heavy auger flights is clearly needed. For carrying out such a method, a highly maneuverable kerf boring machine having an auger-advancing-and-retracting means and its own independently operable auger elevating means for selectively positioning its auger-boring means without having to elevate the entire machine is equally necessary. Such a machine is best controlled by a seated operator having all hydraulic controls within his reach, but a motionless operator, surrounded by steel in the cold, damp air of a mine, is often chilled for long periods without relief, thereby causing poor posterior circulation and physical aliments. Consequently, an operator warming means is also required.

SUMMARY OF THE INVENTION

Accordingly, it is an object of this invention to provide a method for boring and utilizing cylindrical kerfs that does not require a storage hole for a large number of auger flights.

It is also an object to provide an augering machine having sufficient maneuverability within a small space to be suitable for cylindrical kerf boring.

It is another object to provide an augering machine having an independently operable auger-elevating means enabling its boring means to operate at any selected elevation from the floor of a mine entry to the roof thereof.

It is an additional object to provide an operator-warming means that is selectively controllable by the operator of a hydraulically operated machine.

In satisfaction of these objects and in accordance with the spirit of this invention, a shallow-hole method is provided herein that is an improvement over the deep-hole method disclosed in Ser. No. 295,511 because a storage hole is not needed for additional auger flights. This shallow-hole method comprises:

A. selecting:

1. a void volume for an expansion void, to be cut as one or more cylindrical kerfs into a mineral face at the end of a mine entry, according to the shattering characteristics of the mineral to be mined;
2. the diameter and number of cylindrical kerfs for providing such a selected volume; and
3. the location and spacing apart of the cylindrical kerfs and of the shot holes with respect to the roof, floor, and walls of the entry being mined and according to the expansion characteristics of a selected explosive;

B. at the respective selected locations therefor, boring the selected cylindrical kerfs to a selected depth and optionally removing the mineral extracted therefrom, drilling the selected shot holes to the same depth, and inserting the selected explosive into the shot holes;

C. sequentially detonating the explosive at selected intervals measured in millseconds so that the mineral surrounding the cyindrical kerfs is shattered and substantially expanded into the expansion void of these kerfs to the selected depth and throughout the height of the mineral seam and substantially along the entire width of the mine entry; and D. removing the shattered mineral before repeating steps A through D to extend the end of the mine entry by another increment equalling the selected depth.

A kerf-boring machine is also provided herein that comprises an all-wheel drive and steering means, a side arm auger-elevating assembly, an elevatable auger-advancing-and-retracting means, an elevatable auger rotational means, an auger assembly including a cutter head and an attached auger flight, an operator warming means, a latching assembly, and an adjustable roof bracing means. With this machine, having exceptional maneuverability because of shorter length and narrower width than existing kerf-cutting machines, a mine entry can be sequentially lengthened by increments equalling the length of the auger flight and at lower electrical energy costs and less powder consumption than when employing standard methods because the bore holes are closer to the expansion voids created by the cylindrical kerfs. An additional advantage is that the right side of the entry is isolated from the effects of the shooting, thereby obviating the dangers of rib rolls, and in a coal mine, the augered coal has relatively small amounts of fines and is directly saleable, in contrast to bug dust.

This machine is more mobile and maneuverable and less costly than conventional kerf-cutting machines so that small operators can utilize them. It is also capable of cutting a cylindrical kerf throughout the full range of the seam height with its own independently operable elevating means. The auger flight and the cutter head are fixedly attached to the machine.

BRIEF DESCRIPTION OF THE DRAWINGS

The kerf boring machine of this invention is shown in FIGS. 1–8, and the method of this invention is illustrated in FIGS. **9*a*–9*e***.

FIG. **1*a*** is a top perspective view of the front roof jack from the front right-hand corner of the machine, with an extension sleeve in exploded relationship and partially broken away.

FIG. **1*b*** is a sectional elevation view of another embodiment of the front roof jack wherein the cylinder and cylinder rod are pivotably attached within heavy pipe sections that are telescopically movable and usable with an extension sleeve of selected length in order to resist heavy thrust loads and reach ceilings of variable height.

Figures 2, 3, 4, 7, 8:
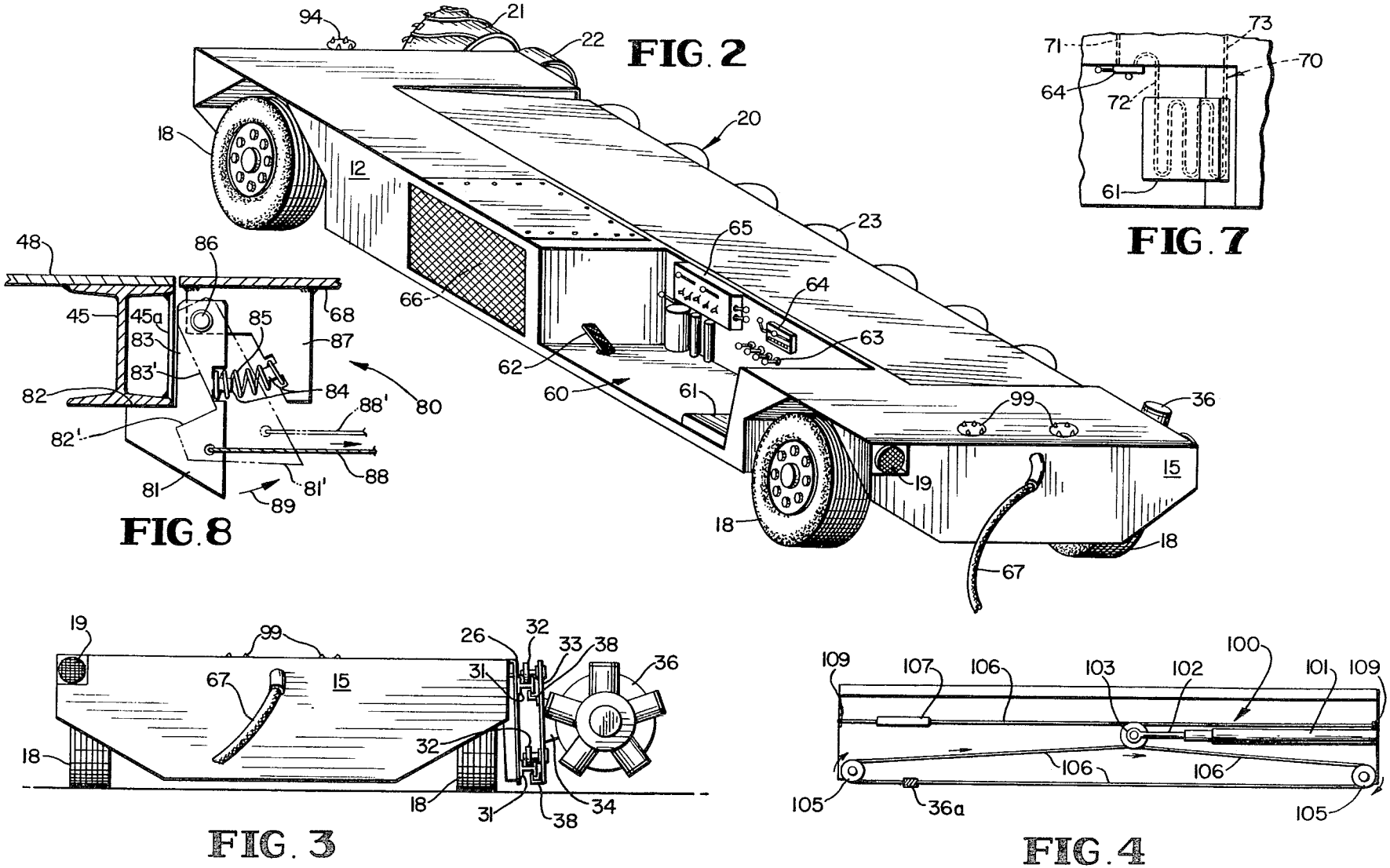

FIG. 2 is a top perspective view of the machine from the rear left-hand corner thereof.

FIG. 3 is a rear elevation view of the machine.

FIG. 4 is a side view of a compact sump device as a suitable auger-advancing-and-retracting means.

Figures 5, 6:
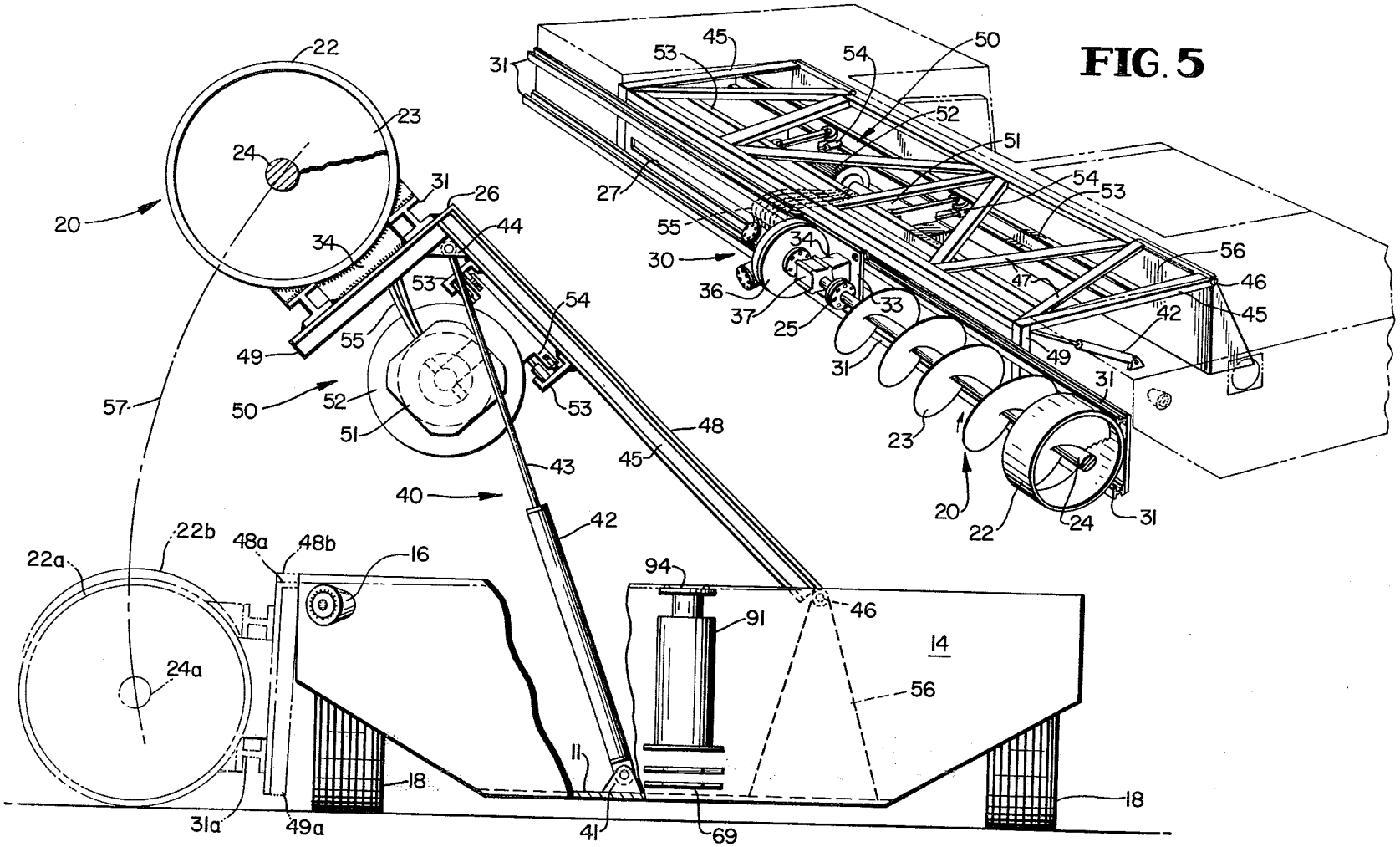

FIG. 5 is a top perspective view, from the front right-hand corner of the machine which is shown in phantom, of the auger assembly with all of the cutter head and a portion of the auger flight removed therefrom and of the auger elevating assembly with the top plate removed therefrom.

Figures 1, 1A, 1B:
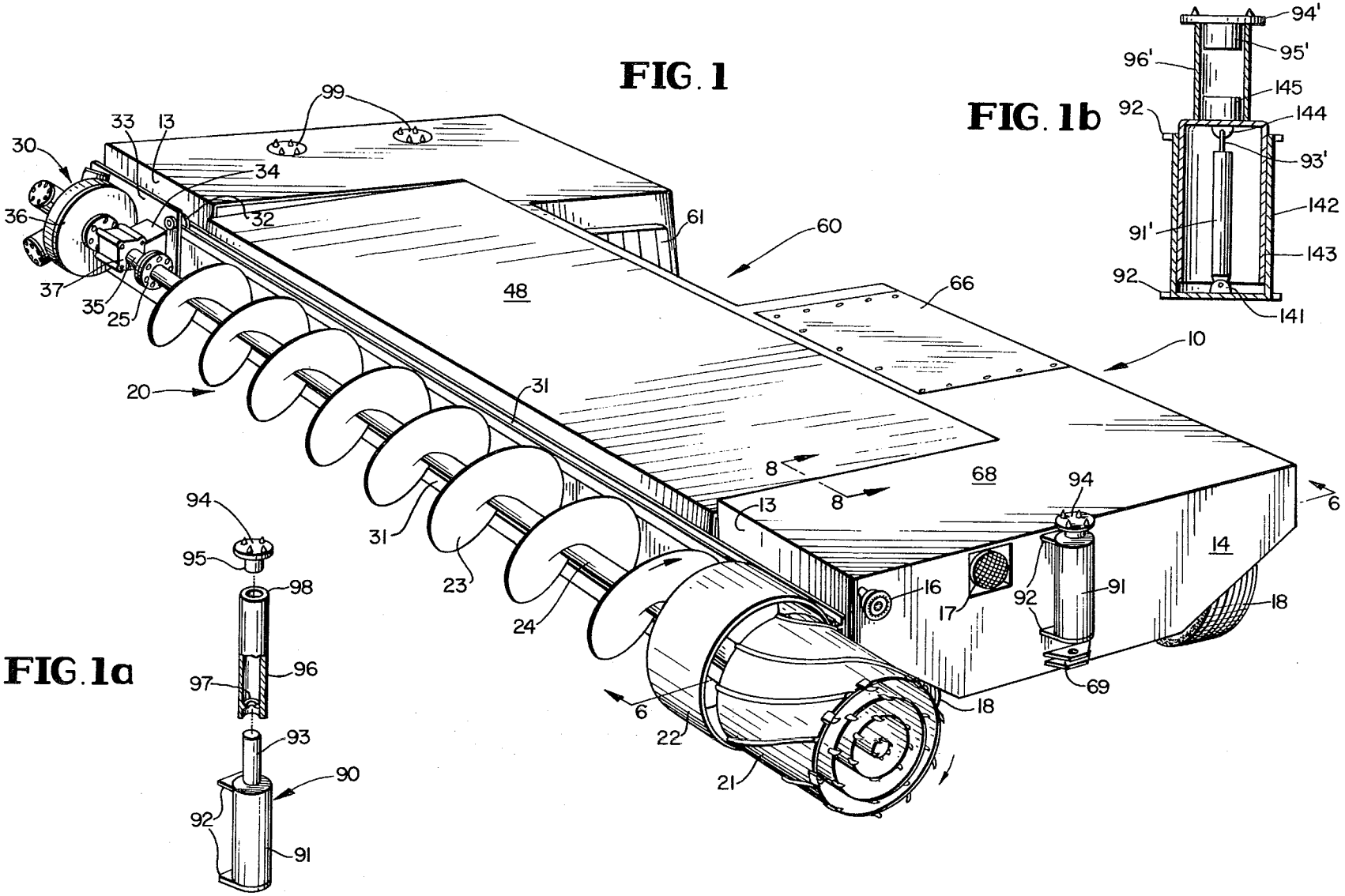
FIG. 1 is a top perspective view of the kerf-boring machine from the right-hand corner thereof.

FIG. 6 is a front elevation view of the machine, taken along the line crossing the arrows 6—6 in FIG. 1 with part broken away to shown the auger elevating assembly, with the auger at top elevation and, in phantom, in tram position and at the floor boring level.

FIG. 7 is a plan view of the operator's seat that shows the operator warming means in phantom.

FIG. 8 is a section, taken along the line crossing the arrows 8—8 in FIG. 1, that shows the front latching assembly in elevation, the pivoted position thereof also being shown in phantom.

FIGS. **9*a*–9*e*** are front elevations of the face of a mine entry, in a mine such as coal mine, showing five sequential stages in entry development by use of the shallow-hole cylindrical kerf method.

FIG. **9*a*** shows the face having two pairs of shallow-hole cylindrical kerfs bored therein, one pair being along the right-hand rib and the other pair being approximately in the middle of the face, and a plurality of shot holes which are suitably spaced from the kerfs and from the roof, floor and walls of the entry.

Figure 9A:
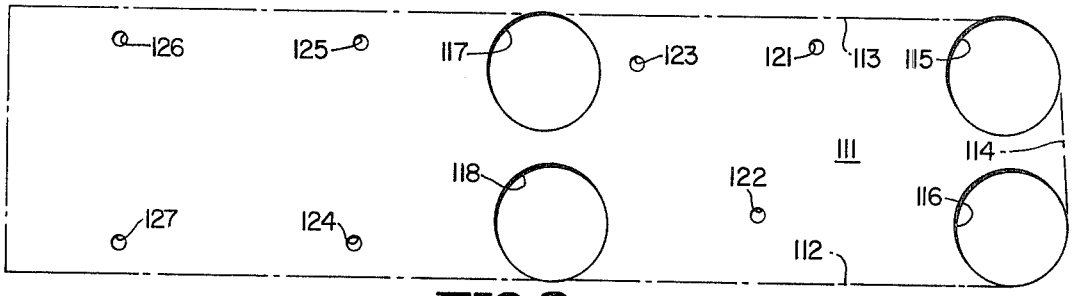
Figure 9B:
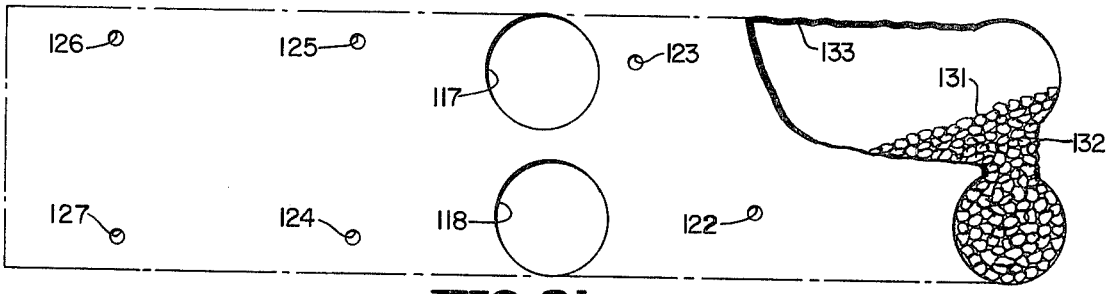

FIG. 9*b* shows the face of FIG. 9*a* after shooting the first shot hole, whereby both of the right-hand kerfs have been joined to form a substantial expansion void along the right-hand wall.

Figure 9C:
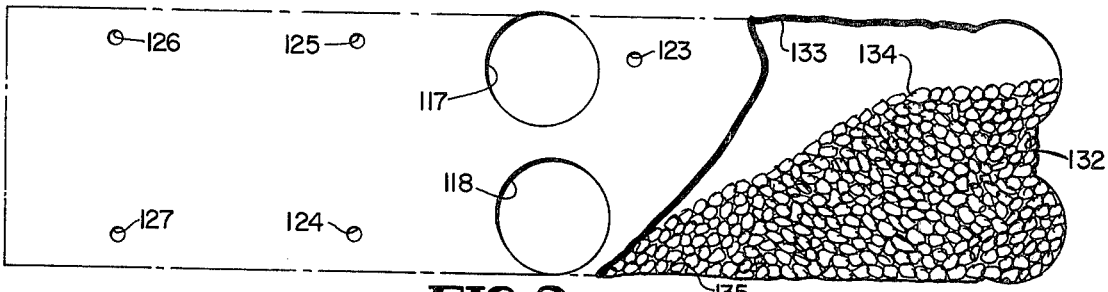

FIG. 9*c* shows the face of FIG. 9*b* after shooting the second shot hole.

Figure 9D:
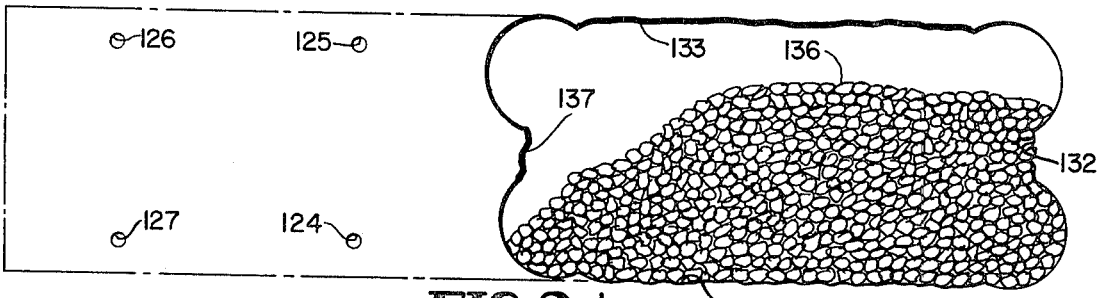

FIG. 9*d* shows the face of FIG. 9*c* after shooting the third shot hole, whereby all four kerfs have been joined to combine their expansion voids.

Figure 9E:
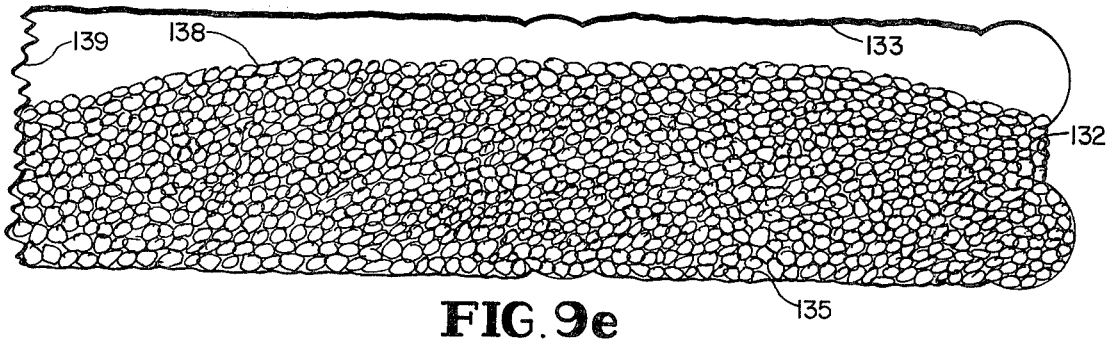

FIG. 9*e* shows the face of FIG. 9*d* after shooting the last four shot holes so that all of the coal in the face has been shattered and released into the combined expansion void of the four cylindrical kerfs.

DESCRIPTION OF THE PREFERRED EMBODIMENTS

The kerf boring machine 10 comprises an auger assembly 20, a hydraulic motor assembly 30, a side-arm elevating assembly 40, a pump assembly 50, an operator station 60, an operator warming assembly 70, a pair of latching mechanisms 80, front and rear jacks 90, and a sump device 100.

The body, frame, and accessories of the machine 10 comprise a bedplate 11, left side 12, right side 13, front plate 14, rear plate 15, spray nozzle 16, front headlight 17, wheels 18, rear headlight 19, tow bracket 69, and main top plate 68.

The side-arm elevating assembly 40, as best seen in FIGS. 5 and 6, comprises, in pairs, a bedplate lug-and-pinion 41 which is rigidly attached to the bedplate 11 and to which a cylinder 42, having a cylinder rod 43, is connected. Each cylinder rod 43 is connected to a corner lug-and-pinion 44 which is rigidly attached to the L-shaped frame formed from a pair of main lifting arms 45, a pair of side arms 49 which are perpendicularly attached thereto, an interconnecting truss structure 47, a top plate 48, and a plurality of arm pins 46 providing pivotal connection to the frame of the machine 10. The arms 45 and the arms 49 are preferably attached at a angle of 92° so that the arms 49 are vertical when resting on the floor 58 and the arms 45 are slightly downwardly inclined. The arms 45 can preferably be lifted to an angle of 45°.

The auger assembly 20 is attached to and selectively elevated by the elevating assembly 40. The assembly 20 comprises an elongated auger plate 26 which is rigidly attached to the side arms 49 and has a longitudinal hose slot 27 therein, an auger cutter head 21, a cylindrical auger guide 22 which is rigidly attached to the plate 26, a single auger flight which is fixedly attached to the cutter head 21 and has a shaft 24 and flight spirals 23, and coupling flanges 25. The auger guide 22 has an inside diameter that is slightly greater than the outside diameter of the spirals 23, as indicated in FIGS. 1 and 6, so that the auger flight fits rotatably therewithin.

The hydraulic motor assembly 30 comprises a pair of horizontally disposed motor rails 31 which are rigidly attached to the plate 26 and substantially spaced apart in parallel, (as shown in FIGS. 3, 5, and 6), a motor support plate 33, two pairs of wheels 32 which are rotatably attached to the plate 33 and are adapted for rollably engaging the webs and flanges of the rails 31 (as indicated in FIG. 3), a mounting bracket 34 which is rigidly attached to the plate 33, a thrust bearing assembly 37 which is rigidly attached to the mounting bracket 34 and through which a motor shaft 35 rotatably passes, and a hydraulic motor 36 which turns the shaft 35 and is connected to the shaft 24 through the pair of flanges 25 so that the motor 36, the auger flight, and the cutter head 21 are fairly rigidly interconnected and are supported entirely by means of the bearing assembly 37 and the guide 22. A pair of guide fingers 38, as seen in FIG. 3, slideably engages the bottom edges of the outer flanges of the pair of rails 31 in order to prevent derailment of the motor 36 by an unforeseen upward motion.

The pump assembly 50, as shown in FIGS. 5 and 6, comprises a pump 51, an electric motor 52, a reservoir 56, a pair of pump rails 53 which are spaced apart in parallel and rigidly attached to the pair of main lifting arms 45, paired travel frame and rollers 54, and travelling hoses 55 which pass through the slot 27, enroute to the motor 36. The motor 52 and pump 51, which are rigidly interconnected, are movably supported by the pair of travel frame and rollers 54 and hang from the rails 53 at any inclination of the arms 45 as the shaft 24 passes through the arc of elevation 57. Because of their inertia and because a longitudinal movement is transmitted almost entirely through the hoses 55, the motor 52 and pump 51 do not generally travel the full length of the slot 57, as indicated in FIG. 5, that the motor 36 travels, but the hoses 55 are never subjected to any serious strain. The elongated reservoir 56 for the hydraulic fluid supports the arm pins 46 at its apex and is rigidly attached to the bedplate 11 at its bottom, thus providing additional structural rigidity to the machine 10.

The operator station 60 comprises an operator seat 61, a heel-and-toe control 62 for forward and reverse movement, hydraulic and tramming controls 63, a starter box 65, and temperature controls 64. A tram motor 66, receiving electrical power through an input line 67, is located nearby. The electric starter box 65 receives power through support line 67 and distributes power to the motors 36, 52, headlights 17, 19, and the like.

The operator warming assembly 70 is in parallel to the return hydraulic system and comprises an incoming hot fluid line 71 tapped from the return hydraulic system to the reservoir 56, a warming line 72 to the operator seat 61, and a return line 73 to the reservoir 56. The warming line 72 has as many convolutions as necessary for imparting a uniform and comfortable amount of heat to the operator so that his circulation is improved and his energy is conserved during a working day underground.

The latching mechanism 80 is used in pairs, the front mechanism, which is identical to the rear mechanism, being shown in FIG. 8; each latch engages and supports a main lifting arm 45 while the machine 10 is tramming so that the side-arm elevating assembly 40 is protected from shocks and other jostling damage because of passage over the rough floor of a mine entry, such damage being potentially significant, even at the conventional tramming speed of 3 miles per hour.

As shown in FIG. 8, a latch mechanism 80 comprises an L-shaped latch plate 81 which pivots on pin 86 and has a load-bearing surface 82 upon which rests the bottom flange of the front main lifting arm 45 and a cam surface 83 which engages the outer edge of the bottom flange of the arm 45. The pin 86 is also connected to a lug 87 which is rigidly attached to the main top plate 68. The latch plate 81 and the lug 87 also have recessed apertures and protruding fingers defining spring seats 84 which are disposed in opposed relationship and into which a compression spring 85 is seated.

A cable 88 is also attached to the lower portion of the latch plate 81 so that when pulled from the operator station 60 into position 88', latch plate 81 is pivoted in direction 89 into position 81', as shown in phantom, while compressing the spring 85. The side-arm elevating assembly is thereby free to be lowered some six inches to the level of the floor 58, as indicated in FIG. 6 as to top plate positions 48*b*, 48*a* and auger guide positions 22*b*, 22*a*. In other words, the auger guide 22, which is shown in highly elevated position in FIG. 6, rides during tramming while supported by the paired latch mechanisms 80 as guide 22*b*, but is closer to floor 58 as guide 22*a* when the machine 10 is boring at the lowest possible level.

The front and rear jacks 90 are a roof-engaging device for the purpose of anchoring the machine 10 by means of its own braked tires 18. As shown in detail in FIGS. 1*a* and 1*b* for the front jack, the jacks 90 are readily extendible for higher-than-ordinary roofs in a mine entry. A stoutly constructed cylinder 91 is attached to the body of the machine 10 by lugs 92 and has a piston rod 93 which fits into an expansion sleeve 96, of any reasonable selected length, until it engages a seat 97 therewithin. A disc rod 95, attached to a top disc 94 having a non-slip top surface, fits into the upper end of the sleeve 96 so that the annular bottom of the disc 94 rests upon the top edge 98. Similar discs 99 at the top of the pair of rear jacks are visible in FIGS. 1–3. The alternative embodiment which is shown in FIG. 1*b* permits a cylinder 91' and cylinder rod 93' of ordinary construction to be used by attaching the cylinder 91' to a lug-and-pinion 141 within an upright thrust pipe 142 within which a slightly smaller pipe 143 is telescopically slideable. A pipe rod 145 at the top of the inner pipe 143 fits within a selected extension sleeve 96'.

The sump device 100, shown in FIG. 4, is attached to any longitudinally disposed member of the auger assembly 20, hydraulic motor assembly 30, or side-arm elevating assembly 40 but is preferably located immediately behind and closely adjacent to the auger plate 26 to which a pair of pulleys 105 are rotatably attached. A telescoping cylinder 101, having a piston rod 102 with a double pulley 103 at the end thereof, functions as the sump jack. A cable 106 is tied down at each end 109 and is kept taut with a cable tightener 107. When piston rod 102 is withdrawn, the cable 106, to which the plate 33 is attached, moves twice as far as the piston rod 102. A 5 foot stroke thereby provides a 10 foot movement of the auger flight.

FIGS. 9*a* through 9*e* show five phases of entry development according to the shallow-hole method of this invention. A face 111 of an entry in a coal mine is shown with cylindrical kerfs 115, 116, 117, 118 bored thereinto to a selected depth such as ten feet in nearly vertically disposed pairs, the kerfs actually being arcuately disposed along arc 57 as seen in FIG. 6. Kerfs 116, 118 are preferably aligned with the floor 112 of the entry, kerfs 115, 116 are preferably aligned with the right side 114 of the entry, and kerfs 115, 117 are preferably aligned with the roof 113 thereof. Typical dimensions are 55 inches for the height of the entry and 24 inches for the diameter of the kerfs 115–118. Shot holes 121–127 are also bored to an equal depth and according to a pattern selected for the explosive to be used (i.e., a hot explosive is needed for less friable mineral or for greater thicknesses to be broken). A wide variety of patterns for the shot holes 121–127 other than that shown in FIGS. 9*a*–9*e* are of course available according to a shot foreman's judgment. The shot holes may be spaced at any distance desired from the roof, floor, walls, and kerfs and may also be as numerous as is economically feasible.

After the explosive in shot hole 121 has been detonated, thereby hurling shattered mineral into the void of kerf 115 and also into the void of kerf 116 after breaking the web therebetween, the roof 133 is partially developed, the broken web 132 is formed and merely needs some scraping to complete an unusually smooth entry wall or rib and the broken mineral having top surface 131 is piled into both voids. The dangerous charactertic of mine entries which are developed by shooting explosives in a frangible mineral such as coal and known as rib roll, a name applied to large chunks of mineral suddenly breaking off from a jagged side or rib of an entry, is thereby obviated on one entire side of the entry being developed according to the shallow-hole method of this invention.

After the explosive in shot hole 122 has been exploded next in millisecond-interval sequence, the floor 135 is partially developed, and the top 134 of the broken mineral slopes downwardly away from the right side of the entry and toward the unbroken mineral.

After the explosive in shot hole 123 has next been exploded, all four kerfs are connected and there is a relatively large void area left unfilled, with top 136 and a broken web area 137. Explosion of the next four shot holes 124–127 finally creates a large pile of shattered mineral with top surface 138 and a relatively jagged left side 139. When this pile has been removed, augmenting the chunky material removed by the auger from the kerfs 115–118, another set of kerfs and shot holes can be bored.

The kerf-boring machine 10 of this invention can be constructed with the operator station 60 and the auger assembly 20 in reversed position, i.e. with boring capability on the left side of the machine. Dual capability is also feasible by placing the operator station in the rear of a slightly wider machine.

In addition, this machine is useful as a shot-hole drilling platform by mounting a self-elevatable bore drill close to the arm pins 46 for boring the shot holes 121–127 and for boring inclined shot holes into a roof above the unmined coal beyond an entry face.

It will be readily apparent to those skilled in the art that various modifications and alterations may be made in the shallow-hole cylindrical kerf method described hereinbefore and in the form, construction, and arrangement of the various parts of the kerf boring machine without departing from the basic principles and purpose of the invention. Such modifications and alterations are consequently intended to be included within the spirit and scope of the invention unless necessarily excluded therefrom by the appended claims when broadly construed.

What is claimed is:

1. A kerf boring machine, comprising:

A. a side-arm elevating assembly which comprises an L-shaped frame formed from a pair of main lifting arms and a pair of side arms which are perpendicularly attached thereto; and B. an auger assembly which comprises:

1. an auger plate which is rigidly attached to said side arms,
2. an auger guide which is rigidly attached to said auger plate,
3. a cutter head, and 4. an auger flight, having an auger shaft and spirals, which fits rotatably within said guide and is attached to said cutter head.

2. The machine of claim 1 wherein said plate has a longitudinally disposed hose slot therein.

3. The machine of claim 2 which further comprises a hydraulic motor assembly.

4. The machine of claim 3 wherein said hydraulic motor assembly comprises a pair of rails which are disposed in parallel to said slot, substantially spaced apart in parallel, and attached to said auger plate.

5. The machine of claim 4 wherein said hydraulic motor assembly further comprises a motor support plate which is slideably attached to said pair of rails, a mounting bracket which is rigidly attached to said motor support plate, a bearing assembly which is rigidly attached to said mounting bracket and through which a motor shaft rotatably passes, and a hydraulic motor which turns said motor shaft, said motor shaft and said auger shaft being connected to provide simultaneous rotation thereof.

6. The machine of claim 5 which further comprises a pump assembly which is slideably attached to said side-arm elevating assembly.

7. The machine of claim 6 wherein said pump assembly comprises a pair of pump rails which are parallel and spaced apart and rigidly attached to said main lifting arms in parallel to said hose slot.

8. The machine of claim 7 wherein said pump assembly further comprises a paired travel frame and rollers which engage said pump rails and movably support said pump assembly at any inclination of said side-arm elevating assembly.

9. The machine of claim 1 wherein said machine further comprises an operator station having a warming means for selectively warming an operator when seated on an operator seat.

10. The machine of claim 9 wherein said warming means is an operator warming assembly comprising an incoming hot fluid line from a return system, a temperature control operable by said operator, a warming line from said temperature control to said operator seat, and a return line to a reservoir for said fluid.

11. The machine of claim 1 which further comprises a pair of latching mechanisms which selectively support said pair of main lifting arms while in tram position, each of said pair of latching mechanisms comprising a latch plate, having a loadbearing side adapted to support one of said arms and a cam side adapted to engage the outer bottom edge of said one arm during descent thereof, a lug which is attached to said machine, a pin which rotatably connects said latch plate and said lug, and a compression spring which is attached to and disposed between said latch plate and said lug.

12. The machine of claim 11 wherein said each latching mechanism further comprises a cable attached to said latch plate and passing to an operator station whereby an operator therein can cause said latch plate to pivot out of the way of said supported main lifting arm and thereby permit said L-shaped frame to descend from said tram position to a floor position.

13. A kerf boring machine, having a frame and four wheels, for sequentially boring cylindrical kerfs to a shallow depth into the face of the mine entry, comprising:

A. an all-wheel drive and steering means for maneuvering said machine within a small space;

B. a side-arm elevating assembly, comprising a pair of main lifting arms which are pivotably connected to said frame near the mid-section thereof;

C. an auger assembly, including an auger cutter head and a fixedly attached auger flight having length equalling said shallow depth, that is movably attached to said side-arm elevating assembly;

D. an elevatable auger rotational means, for rotating said auger cutter head and said attached flight during said boring, that is movably attached to said side-arm elevating assembly; and E. an elevatable auger-advancing-and retracting means, for advancing said auger assembly during said boring and for retracting said auger assembly after said boring.

14. The kerf boring machine of claim 13 wherein said side-arm elevating assembly comprises a pair of side arms which are attached to said pair of main lifting arms at an angle of 92° and an elevating means for selectively elevating said main lifting arms from a position slightly below horizontal to an elevation of about 45°.

15. The kerf boring machine of claim 14 wherein said auger rotational means and said auger assembly are slideably attached to said pair of side arms.

16. The kerf boring machine of claim 14 which further comprises a pump assembly which is slideably attached to said pair of main lifting arms.

17. An augering machine for underground mining of minerals which comprises:

A. a frame;

B. a pump assembly;

C. a hydraulic motor assembly, for rotating a fixedly attached auger flight, which is connected to said pump assembly with travelling hydraulic hoses; and D. a side-arm elevating assembly which is pivotably attached to said frame, comprising elongated support means for slideably supporting both said pump assembly and said hydraulic motor assembly while boring into a mineral face with said auger flight at any elevation from the floor of a mine entry to the roof thereof.

18. The machine of claim 17 which further comprises four steerable wheels and a tramming motor for rotating said wheels.

19. The machine of claim 17 wherein said elongated support means comprises:

A. an elongated and horizontally disposed auger plate which is rigidly attached to said side-arm elevating assembly;

B. a pair of horizontally disposed motor rails, for said slideably supporting said hydraulic motor assembly, which are rigidly attached to said auger plate and substantially spaced apart in parallel; and C. a pair of pump rails, for said slideably supporting said pump assembly, which are horizontally disposed, spaced apart in parallel, and rigidly attached to said side-arm elevating assembly.

* * * * *